US007048066B2

(12) United States Patent
Ringgenberg et al.

(10) Patent No.: US 7,048,066 B2
(45) Date of Patent: May 23, 2006

(54) DOWNHOLE SEALING TOOLS AND METHOD OF USE

(75) Inventors: Paul D. Ringgenberg, Spring, TX (US); Gregory W. Vargus, Duncan, OK (US); Lee Wayne Stepp, Comanche, OK (US); Donald R. Smith, Wilson, OK (US); Ronald L. Hinkie, Marlow, OK (US); Don S. Folds, Duncan, OK (US)

(73) Assignee: Halliburton Energy Services, Inc., DUncan, OK (US)

( * ) Notice: Subject to any disclaimer, the term of this patent is extended or adjusted under 35 U.S.C. 154(b) by 86 days.

(21) Appl. No.: 10/268,439

(22) Filed: Oct. 9, 2002

(65) Prior Publication Data

US 2004/0069503 A1 Apr. 15, 2004

(51) Int. Cl.
*E21B 33/12* (2006.01)

(52) U.S. Cl. ..... 166/387; 166/187; 166/285; 166/181; 166/117; 166/177.4

(58) Field of Classification Search ..... 166/387, 166/285, 293–295, 179, 181, 177.1, 187, 166/177.4, 147, 191, 117
See application file for complete search history.

(56) References Cited

U.S. PATENT DOCUMENTS

| | | | | |
|---|---|---|---|---|
| 1,513,228 | A * | 10/1924 | Crotto | 166/185 |
| 2,187,480 | A * | 1/1940 | Baker | 166/250.14 |
| 2,630,864 | A * | 3/1953 | Lynes | 166/141 |
| 3,097,698 | A * | 7/1963 | Corley, Jr. et al. | 166/162 |
| 3,291,218 | A * | 12/1966 | Lebourg | 166/134 |
| 3,799,260 | A | 3/1974 | Barrington | 166/296 |
| 4,403,656 | A * | 9/1983 | Ploeg et al. | 166/179 |
| 4,458,752 | A | 7/1984 | Brandell | 166/187 |
| 4,706,746 | A | 11/1987 | White et al. | 166/106 |
| 4,714,117 | A | 12/1987 | Dech | 166/380 |
| 4,915,171 | A | 4/1990 | McMahan | 166/264 |
| 4,968,184 | A | 11/1990 | Reid | 405/225 |
| 5,097,902 | A | 3/1992 | Clark | 166/187 |
| 5,143,015 | A | 9/1992 | Lubitz et al. | 166/187 |
| 5,224,540 | A | 7/1993 | Streich et al. | 166/118 |
| 5,271,461 | A | 12/1993 | Decker et al. | 166/185 |
| 5,271,468 | A | 12/1993 | Streich et al. | 166/387 |
| 5,314,015 | A | 5/1994 | Streich et al. | 166/184 |
| 5,390,737 | A | 2/1995 | Jacobi et al. | 166/184 |
| 5,472,052 | A * | 12/1995 | Head | 166/298 |
| 5,488,994 | A | 2/1996 | Laurel et al. | 166/387 |
| 5,540,279 | A | 7/1996 | Branch et al. | 166/118 |
| 5,671,809 | A * | 9/1997 | McKinzie | 166/285 |

(Continued)

FOREIGN PATENT DOCUMENTS

WO WO 2004/007899 A1 1/2004

OTHER PUBLICATIONS

Halliburton brochure entitled "FAS DRILL® SVB Squeeze Packers" dated 2002.

(Continued)

*Primary Examiner*—Kenneth Thompson
(74) *Attorney, Agent, or Firm*—John W. Wustenberg; Haynes & Boones, LLP

(57) ABSTRACT

A downhole tool apparatus for insertion into and sealing engagement with a wellbore. The downhole tool includes upper and lower casing engaging members and an intervening sealing member. In one aspect the intervening sealing member may be a deformable material. In another aspect, the intervening sealing member may be a flowable material cured in the well bore.

35 Claims, 5 Drawing Sheets

U.S. PATENT DOCUMENTS

| | | | | |
|---|---|---|---|---|
| 5,701,959 | A | 12/1997 | Hushbeck et al. | 166/387 |
| 5,718,288 | A * | 2/1998 | Bertet et al. | 166/287 |
| 5,738,171 | A | 4/1998 | Szarka | 166/289 |
| 5,813,460 | A | 9/1998 | Ringgenberg et al. | 166/250.17 |
| 5,832,998 | A | 11/1998 | Decker et al. | 166/185 |
| 5,839,515 | A | 11/1998 | Yuan et al. | 166/387 |
| 5,988,276 | A | 11/1999 | Oneal | 166/118 |
| 6,220,349 | B1 | 4/2001 | Vargus et al. | 166/138 |
| 6,478,086 | B1 * | 11/2002 | Hansen | 166/250.17 |
| 6,805,199 | B1 * | 10/2004 | Surjaatmadja | 166/309 |
| 2004/0007366 | A1 * | 1/2004 | McKee et al. | 166/387 |

OTHER PUBLICATIONS

Halliburton brochure entitled "FAS DRILL® Bridge Packers" dated 1999.

Halliburton brochure entitled "FAS DRILL® Squeeze Packers" dated 1999.

* cited by examiner

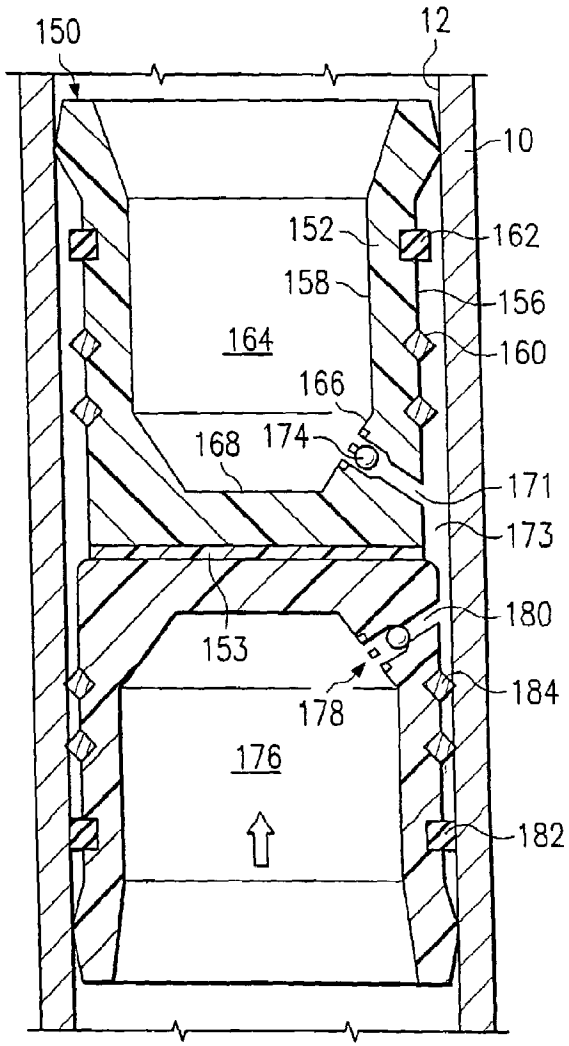
FIG. 3A
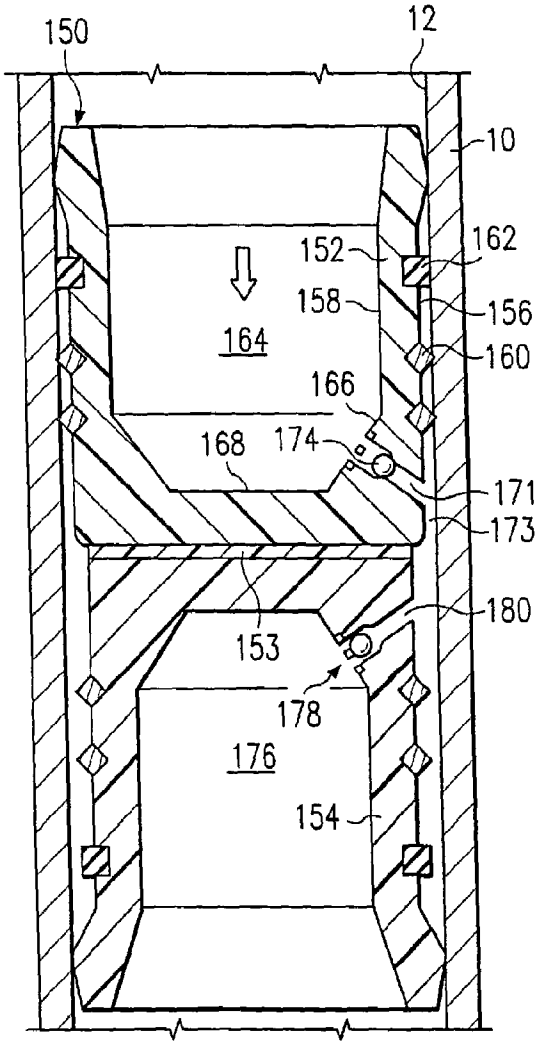
FIG. 3B
FIG. 3C

DOWNHOLE SEALING TOOLS AND METHOD OF USE

BACKGROUND

The present invention relates generally to downhole sealing systems for use in subterranean wells.

In the drilling and completion of oil and gas wells, a great variety of downhole tools are used. For example, but not by way of limitation, it is often desirable to seal tubing or other pipe in the casing of the well. Downhole tools referred to as packers and bridge plugs are designed for these general purposes and are well known in the art of producing oil and gas.

When it is desired to remove many of these downhole tools from a wellbore, it is frequently simpler and less expensive to mill or drill them out rather than to implement a complex retrieving operation. In milling, a milling cutter is used to grind the packer or plug, for example, or at least the outer components thereof, out of the wellbore. Milling is a relatively slow process, but milling with conventional tubular strings can be used to remove packers or bridge plugs having relative hard components such as erosion-resistant hard steel.

In drilling, a drill bit is used to cut and grind up the components of the downhole tool to remove it from the wellbore. This is a much faster operation than milling, but requires the tool to be made out of materials which can be accommodated by the drill bit.

Such drillable devices have worked well and provide improved operating performances at relatively high temperatures and pressures. A number of U.S. patents in this area have been issued to the assignee of the present invention, including U.S. Pat. Nos. 5,224,540; 5,271,468; 5,390,737; 5,540,279; 5,701,959; 5,839,515; and 6,220,349, which are hereby incorporated by reference herein in their entirety. However, drilling out hardened iron components may require certain techniques to overcome known problems and difficulties. The implementation of such techniques often results in increased time and costs.

Improvements in the area of drillable downhole tools are still needed and the present invention is directed to that need.

BRIEF DESCRIPTION OF THE DRAWINGS

FIG. 3A is a partial cross-sectional view of a wellbore casing having a downhole tool disposed therein according to a third embodiment of the present invention.

FIG. 3B is a partial cross-sectional view of the downhole tool of FIG. 3A shown in a first sealing configuration.

FIG. 3C is a partial cross-sectional view of the downhole tool of FIG. 3A shown in a second sealing configuration.

DETAILED DESCRIPTION

Figure 1A:
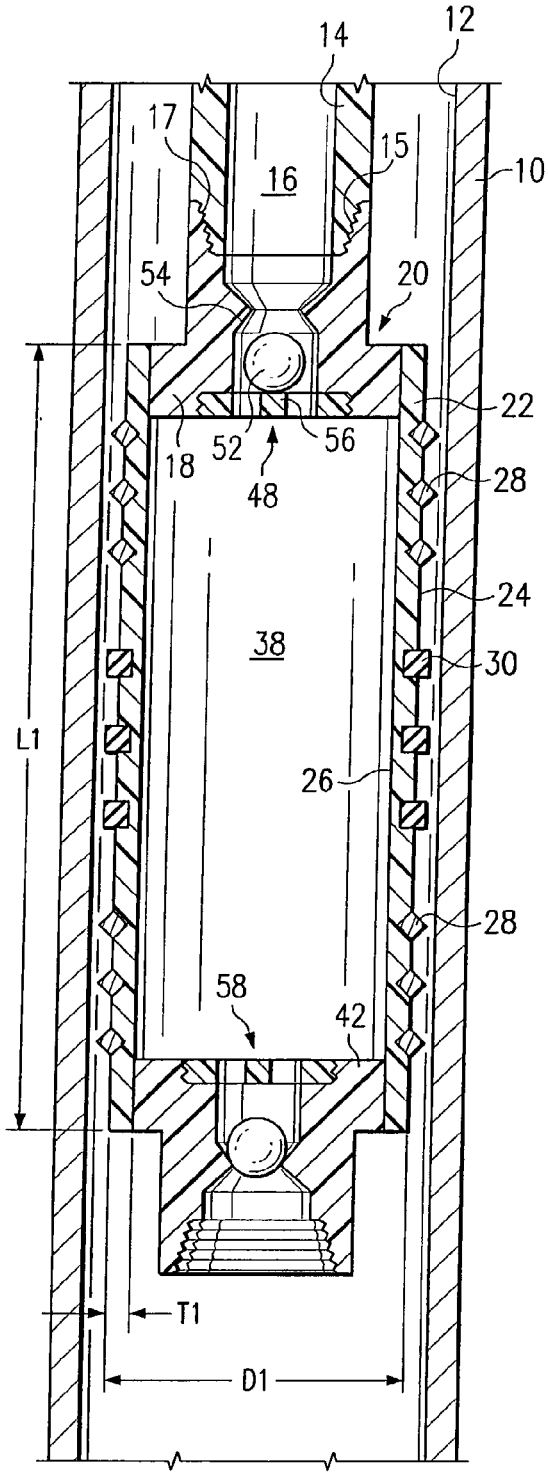
FIG. 1A is a partial cross-sectional view of a wellbore casing having a downhole tool disposed therein according to a first embodiment of the present invention.

Referring to FIG. 1A, there is shown disposed in a well a well casing 10 having an internal surface 12 with an internal diameter. It will be understood that the well casing 10 may represent any tubular member disposed within a subterranean wellbore including tubing, jointed pipe, coiled tubing, or any other tubular structure that may be positioned in a subterranean wellbore. Disposed within the well casing 10 is a workstring 14 having external threads 15 at its lower end and an internal fluid passage 16. A downhole tool 20 is suspended on the workstring 14 by engagement of the external threads 15 with internal threads 17 disposed in an upper plug 18 of the downhole tool 20. In alternative embodiments, the downhole tool 20 could also be suspended on a wire line, coiled tubing, or attached to the workstring 14 with a standard adapter kit, known in the art. The well can be either a cased completion as shown in FIG. 1A or an openhole completion.

The downhole tool 20 is comprised of a tubular member 22 having an outer surface 24 and an inner surface 26. In one aspect of the invention, the tubular member 22 is formed of a substantially uniform material throughout and may include a single material or be a composite of several different materials distributed throughout the tubular member 22. The tubular member 22 may be made from a relatively expandable material so that it can expand horizontally as explained in more detail below. These materials are preferably selected such that the packing apparatus can withstand wellbore working conditions with pressures up to approximately 10,000 psi and temperatures up to about 425° F. In one preferred embodiment, but without limitation, the materials of the downhole tool 20 are selected such that the downhole tool 20 can withstand well pressures up to about 5,000 psi and temperatures up to about 250° F. Such materials may include engineering grade plastics and nylon, rubber, phenolic materials, or composite materials. As will be explained in greater detail in reference to FIGS. 1C through 1H, the outer surface 24 includes a plurality of grips 28 and sealing members 30. It is anticipated that the grips 28 will have a hardness substantially greater than the material forming the tubular member 22 and that sealing members 30 will have a hardness less than the hardness of the material forming the tubular member 22.

The downhole tool 20 separates the well casing 10 into an upper casing passage 32 and a lower casing passage 34. The inner surface 26 of the tubular member 22 defines an internal chamber 38 enclosed by the upper plug 18 engaging the upper end of the downhole tool 20 and a lower plug 42 engaging the inner surface 26 adjacent to the lower end of the downhole tool 20. The upper plug 18 includes a one-way valve 48 configured to permit flow into the internal chamber 38 from the fluid passage 16 in the workstring 14 and to limit flow out of the internal chamber 38 back into the fluid passage 16. The one-way valve 48 comprises a ball 52, a valve seat 54, and a ball stop 56. When the ball 52 is positioned adjacent to the ball stop 56 and spaced from the valve seat 54, fluid may flow around the ball 52 into the internal chamber 38. However, when the ball 52 engages the valve seat 54, fluid flow from internal chamber 38 into the fluid passage 16 is prevented.

The lower plug 42 may also include a one-way valve 58. The one-way valve 58 is identical to, and operates in a manner similar to, the one-way valve 48. The one-way valve 58 may be adapted to permit fluid flow into the internal chamber 38 and limit fluid flow out of the internal chamber 38 into the lower casing passage 34, as will be described below.

Figure 1B:
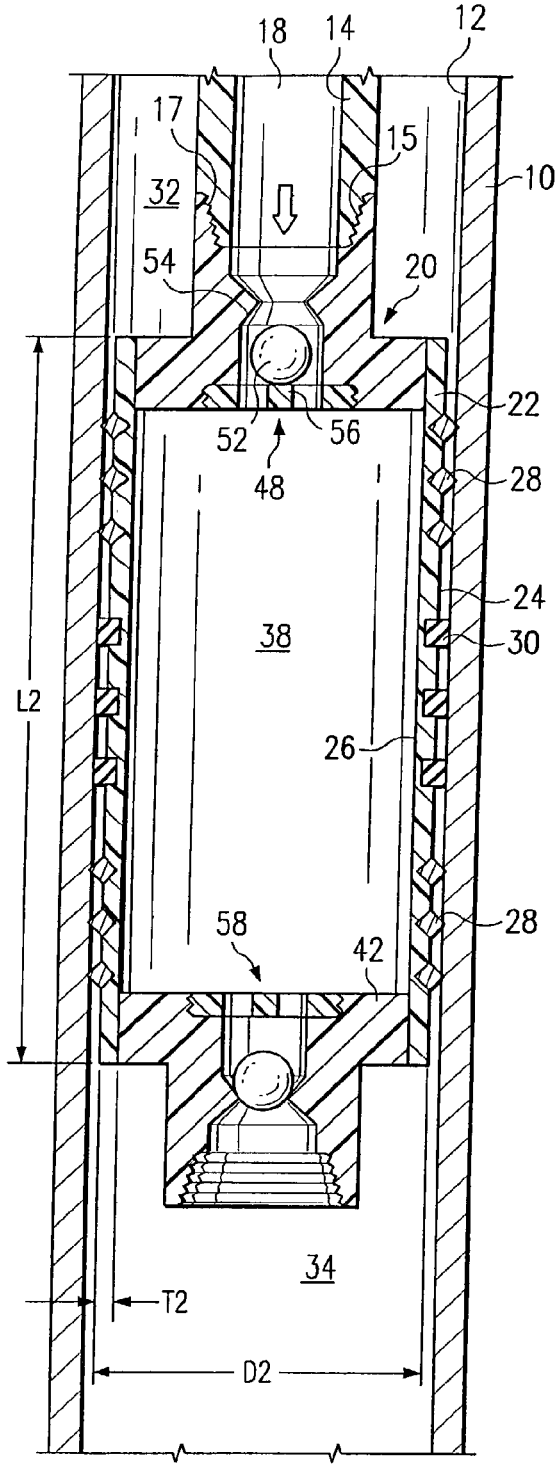
FIG. 1B is a partial cross-sectional view of the downhole tool of FIG. 1A shown in a sealing configuration.

In FIG. 1A, the downhole tool 20 is illustrated in a "run in" or insertion configuration with the tubular member 22 having a maximum diameter D1 and a length L1. FIG. 1B depicts the downhole tool 20 after it has been expanded in a manner to be described, to a set configuration in which it has a diameter D2 and a length L2. It will be understood that the diameter D2 is greater than the diameter D1 such that grips 28 are urged against the internal surface 12 to maintain the longitudinal position of the downhole tool 20. In a preferred aspect, the grips 28 at least slightly penetrate the internal surface 12 to thereby resist longitudinal movement of the downhole tool 20. In a similar manner, the expansion of the downhole tool 20 to the diameter D2 urges the sealing members 30 against the internal surface 12 to establish a fluid seal against the well casing 10. In the illustrated embodiment, the expansion of the diameter from D1 to D2 also results in shortening of the length from L1 to L2. Furthermore, as shown in FIG. 1A, the tubular member 22 has an initial wall thickness T1 and a wall thickness T2 (FIG. 1B) in its expanded configuration. In the illustrated embodiment, the wall thickness T1 and the wall thickness T2 are substantially equal such that the expansion of the tubular member 22 has little impact on its wall thickness. It will be appreciated by those skilled in the art that the tubular member 22 may be constructed such that the relationship between the wall thickness, length, and diameter of the downhole tool 20 are engineered to establish the desired tradeoffs during the expansion process. More specifically, it will be understood that in an alternative embodiment the length L1 and L2 may be substantially identical with the expansion in diameter resulting primarily from a change in the wall thickness T1 to the smaller wall thickness T.

In operation, the downhole tool 20 may be interconnected with the workstring 14 via the engagement of the external threads 15 with the internal threads 17. In alternative methods, the downhole tool 20 could be positioned with a wire line, coiled tubing or other known well service tools. The downhole tool 20 is initially in the insertion or run-in configuration shown in FIG. 1A and, as such, is advanced through the well casing 10 to the desired tool location. When it is desired to shift the downhole tool 20 from its insertion configuration to its sealing or set configuration, fluid pressure in the fluid passage 16 of the workstring 14 is transmitted into the internal chamber 38 through the one-way valve 48. The initial pressure in the internal chamber 38 causes the one-way valve 58 to close, thereby permitting an increase in the pressure in the internal chamber 38. The increasing pressure differential between the internal chamber 38 and the upper and lower casing passages 32 and 34 causes the tubular member 22 to expand to the diameter D2. Once the downhole tool 20 has been expanded in the well casing 10, the fluid pressure in the fluid passage 16 may be decreased with respect to the internal chamber 38, which will close the one-way valve 48. The workstring 14 may then be disengaged leaving the downhole tool 20 in position to seal and engage the well casing 10. Such disengagement may be accomplished by known methods such as by shearing the interconnection between the workstring 14 and the downhole tool 20.

It is contemplated that the materials of the tubular member 22 will undergo at least partial elastic deformation during the expansion process. With such material selection, the tubular member 22 will tend to contract upon removal of pressure from the internal chamber 38. Alternatively, the material selected for the tubular member 22 may undergo a plastic deformation during the expansion process to maintain grips 28 in engagement with the well casing 10 during the drill out procedure.

In still a further alternative, the internal chamber 38 could be preliminarily pressurized by fluid pressure in the fluid passage 16 of the workstring 14 acting through one-way valve 48 as described above. The preliminary pressurization would at least partially urge the sealing members 30 and the grips 28 against the internal surface 12. After the preliminary pressurization, pressure inside the fluid passage 16 and the well casing 10 above the downhole tool 20 would be reduced creating a pressure differential across the downhole tool 20. The higher pressure fluid from below the downhole tool 20 will enter the internal chamber 38 through the one-way valve 58 and will forcefully urge the tubular member 22 outwardly against the internal surface 12. In this situation, the one-way valve 48 would close allowing the pressure in the internal chamber 38 to increase until it corresponds to the pressure in the well casing 10 below the downhole tool 20. Workstring 14 may be disengaged from the downhole tool 20 after complete seating of the downhole tool 20 in the wellbore.

Once the internal chamber 38 is pressurized by either of the foregoing techniques, the downhole tool 20 is left in place to provide a seal between the upper casing passage 32 and the lower casing passage 34. The downhole tool 20 remains in place while other well operations, known in the art, are performed. Upon the completion of such well operations, the downhole tool 20 may be removed from the wellbore by top drilling the device or by any other known oil field techniques. During the removal procedure, a drill member (not shown) may engage the one-way valve 48 and forcibly unseat the ball 52 from the valve seat 54. It will be understood that this operation will, over time, equalize the pressure between internal chamber 38 and the upper casing passage 32. Furthermore, the one-way valve 58 would then be free to open such that pressure below the downhole tool 20 may also be equalized.

Once the pressure has been equalized, the drill may then continue to remove the non-metallic materials forming the sealing device. In still a further alternative aspect, tubular member 22 may be designed to relax to a smaller diameter configuration upon pressure release. In this embodiment, the downhole tool 20 may be moved within the well casing 10 after pressure release using hydraulic or mechanical forces.

In another embodiment, the tubular member 22 has a natural tendency to expand greater than the diameter of the internal surface 12, thereby continuing to urge grips 28 into contact with the well casing 10 in the absence of a pressure differential. In this embodiment, the tubular member 22 is mechanically held in the elongated configuration shown in FIG. 1A, for example, by an inner mandrel (not shown) extending between the upper plug 18 and the lower plug 42. As the mechanical elongation force is withdrawn, the tubular member 22 may relax to the position shown in FIG. 1B.

Figure 1C:
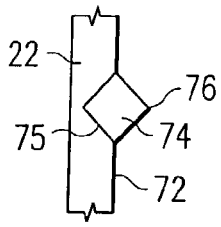
FIG. 1C is a detailed partial cross-sectional view of a gripping element which may be used by the embodiments of the present invention.

A variety of grip and seal embodiments may be used with the various aspects of the present invention. By way of illustration, some of these embodiments are illustrated in FIGS. 1C through 1H. Referring now to FIG. 1C, there is shown a portion of the tubular member 22. Embedded in an exterior surface 72 is a grip member 74 disposed within a recess 75 to maintain its relative longitudinal position along the tubular member 22. The grip member 74 may be molded with the exterior surface 72 such that it is firmly embedded in the material of the tubular member 22. Alternatively, the grip member 74 may be bonded to the exterior surface 72 using adhesives or cement. Still further, it is contemplated that the grip member 74 may be mechanically coupled to the exterior surface 72. The grip member 74 has a point or a substantially horizontal edge 76. The grip member 74 is made from a relatively harder material than the tubular member 22 so that the point or edge 76 can engage the internal surface 12 of the well casing 10 (FIG. 1A).

The grip member 74 may be made of either metallic or non-metallic material. If made from non-metallic material, then the materials could include engineering grade nylon, phenolic materials, epoxy resins, and composites. The phenolic materials may further include any of FIBERITE FM4056J, FIBERITE FM4005, or RESINOID 1360. These components may be molded, machined, or formed by any known method. One preferred plastic material for at least some of these components is a glass reinforced phenolic resin having a tensile strength of about 18,000 psi and a compressive strength of about 40,000 psi, although the invention is not intended to be limited to this particular material or a material having these specific physical properties.

Figure 1D:
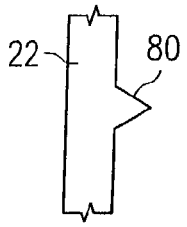
FIG. 1D is a detailed partial cross-sectional view of a gripping element which may be used by the embodiments of the present invention.

FIG. 1D illustrates another embodiment of a grip member. In this embodiment, a wedge 80 is formed with the tubular member 22. The wedge 80 may be made from a material, such as metal, having a hardness sufficient to grippingly engage the internal surface 12 of the well casing 10, although penetrating engagement is not required to maintain the position within the well casing 10. The wedge 80 may be a horizontal semi-circular shape positioned at various points around the circumference of the downhole tool 20. Using a series of short wedges, as opposed to a single radial wedge, would allow the downhole tool 20 to expand without developing ring tension in the wedge 80.

Figure 1E:
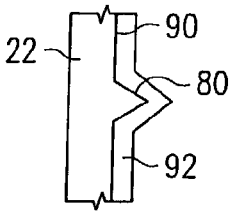
FIG. 1E is a detailed partial cross-sectional view of a gripping element which may be used by the embodiments of the present invention.

FIG. 1E illustrates another embodiment of a grip member with sealing capabilities. This embodiment is similar to the embodiment discussed with reference to FIG. 1D. However, in this embodiment, an exterior surface 90 is coated with a sealing layer 92. The sealing layer 92 may be engineering grade plastic, rubber, phenolics, or composites. Preferably sealing layer 92 is formed of a softer material than the tubular member 22 such that wedge 80 may be forced through the material to engage the well casing 10. The sealing layer 92 provides a seal when the wedge 80 is engaged into the internal surface 12 of the well casing 10.

Figure 1F:
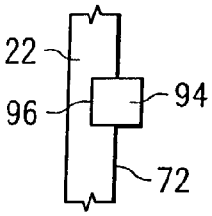
FIG. 1F is a detailed partial cross-sectional view of a sealing member which may be used by the embodiments of the present invention.

FIG. 1F depicts an embodiment of a sealing member. A sealing member 94 is embedded into a recess 96 in the tubular member 22. In this embodiment, the sealing member 94 is rectangular in cross-sectional shape. However, any appropriate cross-sectional shape may be used. For instance, the sealing member 94 could also have a triangular or circular cross sectional shape, or any combination of shapes. As previously explained, the tubular member 22 may be made from a flexible engineering grade plastic, rubber, phenolics, or composites so that it can expand horizontally. The sealing member 94 may be made from engineering grade plastics, rubber, phenolics, or composite that have greater elasticity than the tubular member 22 so that the sealing member 94 will press tightly up against the internal surface 12, thereby creating an effective vertical seal.

Figure 1G:
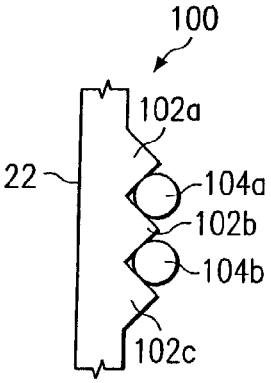
FIG. 1G is a detailed partial cross-sectional view of a sealing member which may be used by the embodiments of the present invention.
Figure 1H:
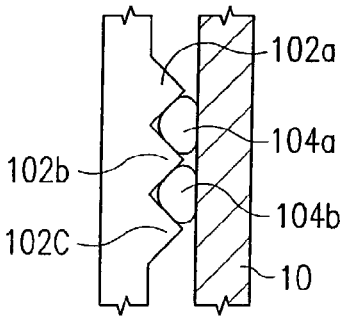
FIG. 1H is a detailed partial cross-sectional view of the sealing member of FIG. 1G shown in a sealing configuration.

A detail of a grip and seal combination system is shown in FIG. 1G. A grip and seal combination 100 includes a plurality of gripping projections 102*a*, 102*b*, and 102*c* extending from the outer surface of the tubular member 22. The gripping projections 102*a*, 102*b*, and 102*c* are formed of a substantially hardened material. Sealing members 104*a* and 104*b* formed of a substantially softer material than the gripping projections 102*a*, 102*b*, and 102*c*, such as engineering grade materials described above, are shown disposed between the gripping projections 102*a*, 102*b*, and 102*c*. It will be understood that as the tubular member 22 expands, the sealing members 104*a* and 104*b* are compressed against the internal surface 12 of the well casing 10. As illustrated in FIG. 1H, this compression causes the sealing members 104*a* and 104*b* to yield such that the harder tips of the gripping projections 102*a*, 102*b*, and 102*c* can project beyond the sealing members 104*a* and 104*b* for engagement with the well casing 10.

Figure 2:
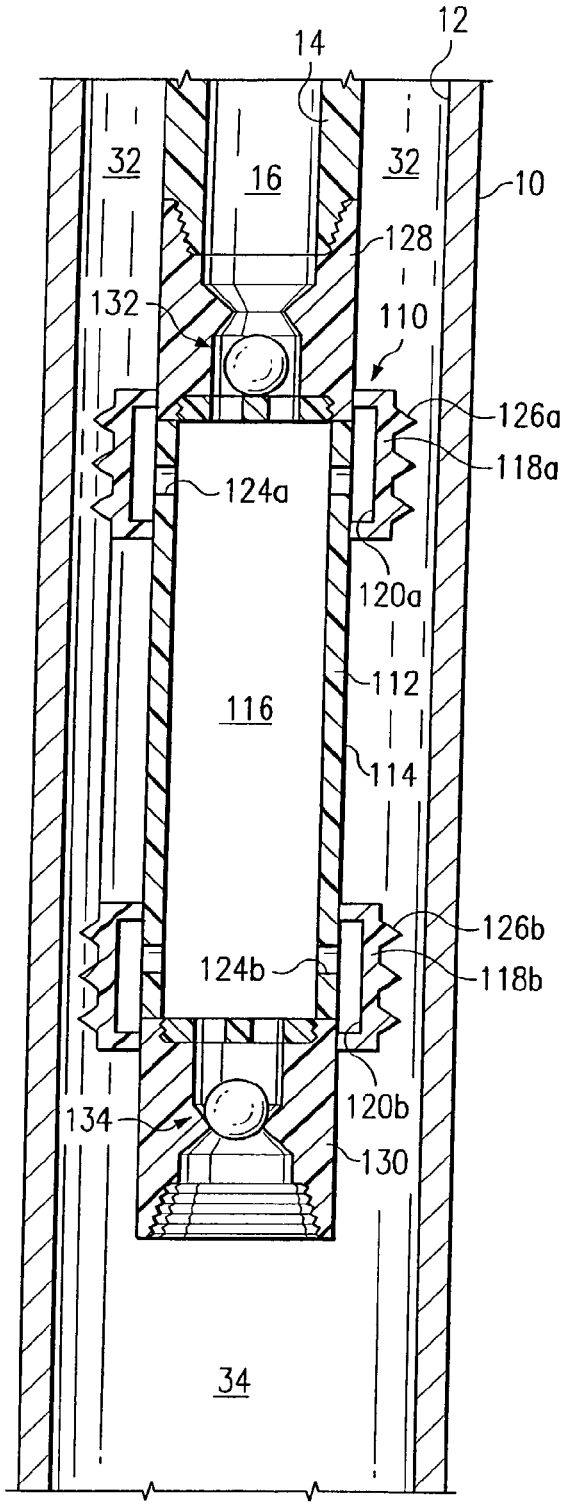
FIG. 2 is a partial cross-sectional view of a wellbore casing having a downhole tool disposed therein according to a second embodiment of the present invention.

Referring now to FIG. 2, there is shown another embodiment of the present invention. A sealing device or downhole tool 110 is shown in FIG. 2 in an insertion configuration positioned within a well environment as previously described including the well casing 10, internal surface 12, workstring 14, fluid passage 16, upper casing passage 32 and lower casing passage 34. The sealing device 110 includes a tubular member 112 having an outer surface 114 and an internal chamber 116. In the illustrated embodiment, an expandable ring member 118*a* is disposed about an upper portion of the tubular member 112. Similarly, a lower expandable ring member 118*b* is disposed about a lower portion of the tubular member 112. The inner surfaces 120*a* and 120*b* of the ring members 118*a* and 118*b* are in hydraulic communication with the internal chamber 116 through a plurality of openings 124*a* and 124*b*, respectively, which are spaced radially around the tubular member 112. Although two ring members 118*a* and 118*b* are illustrated in FIG. 2, any number of ring members could be employed vertically along the tubular member 112.

A plurality of grips 126*a* and 126*b* are disposed on the ring members 118*a* and 118*b*, respectively. Similarly a plurality of sealing members (not shown) such as the sealing members 94 and 104 of previous embodiments may also be disposed on one or both of the ring members 118*a* and 118*b*. Also, the grips 126 could include the sealing layer 92 discussed above in reference to FIG. 1E.

The internal chamber 116 is bounded by an upper plug 128 and a lower plug 130. The upper plug 128 includes a one-way valve 132 permitting fluid flow into the internal chamber 116 but inhibiting fluid leaving the internal chamber 116. In a similar fashion, the lower plug 130 includes a one-way valve 134 permitting fluid flow into the internal chamber 116 but preventing fluid flow therefrom.

In operation, the downhole tool 110 is interconnected with the workstring 14 as discussed above with reference to FIG. 1A. The downhole tool 110 is initially in the insertion or run-in configuration as shown in FIG. 2. The workstring 14 is advanced through well casing 10 to the desired tool location. Then the downhole tool 110 is deployed into its sealing configuration to force the plurality of grips 126*a* and 126*b* against the internal surface 12 of the well casing 10. More specifically, fluid pressure developed through the fluid passage 16 of the workstring 14 is transmitted through the one-way valve 132 into the internal chamber 116. Fluid pressure may be applied through the openings 124*a* and 124*b* to the inner surfaces 120*a* and 120*b*. The pressure exerted on the inner surfaces 120*a* and 120*b* causes the ring members 118*a* and 118*b* to expand until the grips 126*a* and 126*b* reach the internal surface 12 of the well casing 10. Depending on the configuration, this expansion forces the grips 126*a* and 126*b*, also known as sealing members, against the internal surface 12 of the well casing 10. In one aspect as shown in FIG. 2, the grips 126*a* and 126*b* are configured for at least partial penetrating engagement with the internal surface 12 of the well casing 10.

In a manner similar to that discussed above in reference to FIG. 1, the internal chamber 116 could also be pressurized by pressure entering the internal chamber 116 through the one-way valve 134. In any event, once the internal chamber 116 is pressurized and the well casing 10 is engaged by the grips 126*a* and 126*b*, the workstring 14 may then be disengaged leaving the downhole tool 110 in position to seal and engage the well casing 10. Thus, the downhole tool 110 is left in place to provide a seal between the upper casing passage 32 and the lower casing passage 34. The downhole tool 110 remains in place while other well operations, known in the art, are performed. Upon the completion of the well operations, the downhole tool 110 may be removed from the well casing 10 by top drilling the device or by other such removal methods.

Referring now to FIG. 3A, there is illustrated another embodiment of the present invention disposed within the well casing 10 having an internal surface 12. The downhole tool 150 includes an upper tubular member 152 and a lower tubular member 154. In a preferred aspect, a layer 153 formed of a harder material is disposed between the upper and lower tubular members 152 and 154. The upper and lower tubular members 152 and 154 and the layer 153 may be joined together via bonding or other similar material. Further, while independent tubular members are shown, it is contemplated that the upper tubular member 152 and the lower tubular member 154 may be integrally formed with one another with the exclusion of intermediate layer 153.

The upper tubular member 152 includes an outer surface 156 and an opposing inner surface 158. The inner surface 158 may include threads adapted for engagement with a tool string, coiled tubing, wire line, or other well tool. The downhole tool 150 includes an upper flange 157 and a lower flange 159, each having a maximum outer diameter closely approximating the internal diameter of the well casing 10. The outer surface 156 includes a plurality of grips 160 and a sealing member 162. In an alternative embodiment, the grips 160 and the sealing member 162 may be joined to the outer surface 156 as previously described with respect to the embodiments discussed in reference to FIG. 1A through FIG. 1H. The inner surface 158 defines an internal chamber 164 which is further bounded by a tapered surface 166 and a bottom surface 168. The internal chamber 164, tapered surface 166, and bottom surface 168 can be said to define both an open end and a closed end of the upper tubular member 152. An annulus 173 is formed between the internal surface 12 and the outer surface 156. In the illustrative embodiment, a one-way valve 170 including a ball member 174 is disposed in the tapered surface 166 and permits fluid flow from the annulus 173 into the internal chamber 164 through a port 171. Fluid flow in the opposite direction is prevented by the ball member 174. The lower tubular member 154 is constructed in substantially the same configuration as the upper tubular member 152 and defines an internal chamber 176 including a one-way valve 178 communicating through a port 180 to the annulus 173.

The downhole tool 150 may be interconnected with the tool string 14 of FIG. 1A and advanced to the desired location in the well casing 10. To expand the downhole tool 150 to an expanded configuration, hydraulic pressure is applied in the internal chamber 164 to establish a pressure differential between the internal chamber 164 and the annulus 173. In a preferred aspect, the upper flange 157 and the lower flange 159 tend to limit fluid flow past the downhole tool 150 through the annulus 173 thereby assisting in establishing a pressure differential across the tool. The one-way valve 170 is forced to a closed position such that fluid flow between the internal chamber 164 and the port 171 is prohibited. Hydraulic pressure in the internal chamber 164 urges the diameter of the upper tubular member 152 to increase such that the grips 160 and the sealing member 162 are in engagement with the internal surface 12 as shown if FIG. 3B. However, the lower tubular member 154 remains substantially in the insertion configuration.

Alternatively, the downhole tool 150 could be expanded by using the wellbore pressure applied to the internal chamber 176. FIG. 3C illustrates this situation, where the lower tubular member 154 has been expanded to a sealing configuration such that a sealing member 182 and a plurality of grips 184 (similar to the sealing member 162 and the grips 160 previously described) are in engagement with the internal surface 12. Furthermore, the one-way valve 178 is in a closed position to prevent fluid flow from downhole tool 150 to pass beyond the lower tubular member 154 into the annulus 173.

Once either the internal chamber 164 or 176 has been pressurized and the well casing 10 is engaged by the grips 160 or 184, the workstring 14 may then be disengaged leaving the downhole tool 150 in position to seal and engage the well casing 10. The downhole tool 150 remains in place while other well operations, known in the art, are performed. Upon the completion of the well operations, the downhole tool 150 may be removed from the wellbore by top drilling the device or other such removal methods.

Figure 4B:
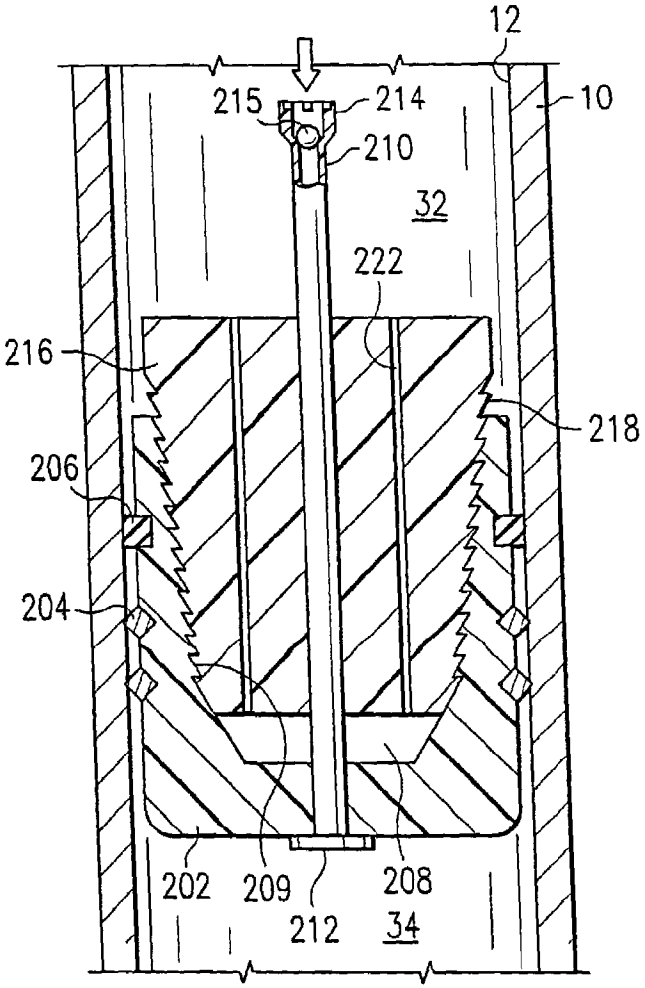
FIG. 4B is a partial cross-sectional view of the downhole tool of FIG. 4A shown in a sealing configuration.
Figure 4A:
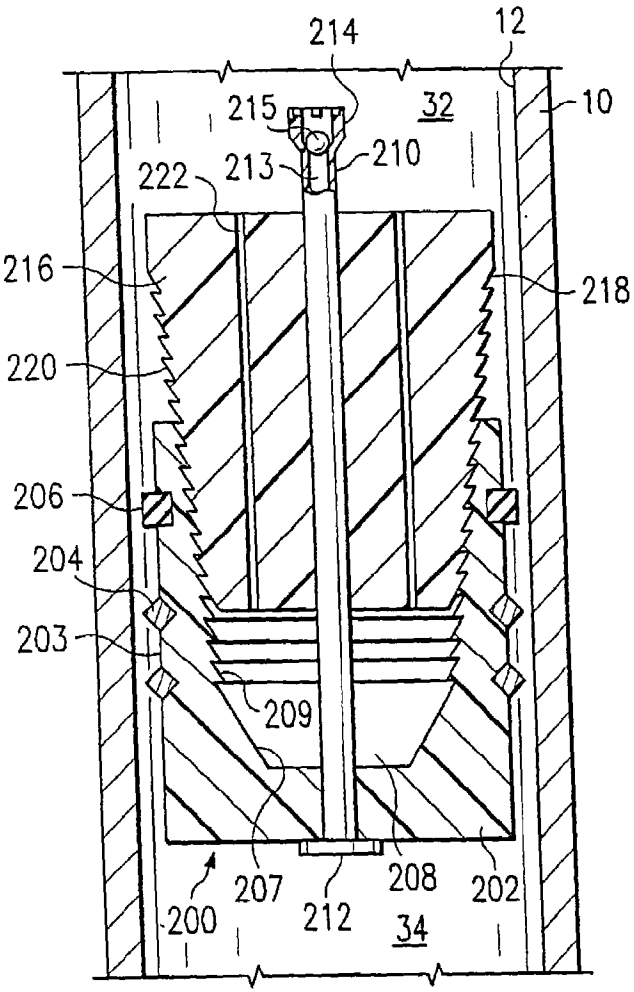
FIG. 4A is a partial cross-sectional view of a wellbore casing having a downhole tool disposed therein according to a fourth embodiment of the present invention.

Referring now to FIGS. 4A and 4B, there is shown a further embodiment of a downhole tool 200 according to an alternative aspect of the invention. As previously depicted, the environment includes the well casing 10, internal surface 12, upper casing passage 32 and lower casing passage 34. In this embodiment, the downhole tool 200 includes a tubular body or cup 202 having a plurality of grips 204 disposed on an outer surface 203 along with a circumferential sealing member 206. The cup 202 has an internal surface 207 extending at a slight taper from an upper portion or end to a lower portion or end and defining an internal chamber 208. Furthermore, the tapered internal surface 207 includes a plurality of projections or ridges 209. An expansion plug 216 includes an outer surface 218 have a taper approximating the configuration of the internal surface 207 and a plurality of ridges or projections 220 adapted to interdigitate with the ridges 209. The plug 216 also includes a plurality of fluid passages 222 and a central passage.

A mandrel 210 extends from the lower portion of the cup 202 through the internal chamber 208 and above the cup 202. The mandrel 210 is fixedly engaged to the cup 202 by an enlarged flange 212 and may include an internal passage 213 for the movement of fluids between the upper casing passage 32 and the lower casing passage 34. A one-way valve 214 including a ball 215 may be disposed in mandrel 210 to initially block fluid flow. The mandrel 210 extends through the central passage formed in the plug 216. The plug 216 is disposed about the mandrel 210 and is adapted for longitudinal movement along the mandrel 210.

In operation, the cup 202 and the plug 216 are coupled on mandrel 210 as shown in FIG. 4A. The downhole tool 200 is then run in to the desired location within the well casing 10 via a tool string such as previously described. The cup 202 is then held in position within the well casing 10 by upward force on the mandrel 210 via the tool string. The plug 216 is then advanced into the internal chamber 208 by a tubular member (not shown) acting on the top of the plug 216 to force it into the cup 202. The movement of the plug 216 into the internal chamber 208 expands the diameter of the cup 202 to forcibly engage the sealing member 206 and the grips 204 with the internal surface 12 of the well casing 10 as is illustrated in FIG. 4B. Fluid trapped in the internal chamber 208 may escape through the fluid passageways 222. The engagement of the ridges 209 with the ridges 220 maintains the plug 216 within the internal chamber 208.

Once the cup 202 has expanded, the downhole tool 200 may be left in place to provide a seal between the upper casing passage 32 and the lower casing passage 34. The downhole tool 200 remains in place while other well operations, known in the art, are performed. Upon the completion of the well operations, the downhole tool 200 may be removed from the wellbore by conventional methods. Upon removal, the one-way valve 214 may be initially removed to establish a fluid path from below the downhole tool 200 to above the downhole tool 200 to thereby equalize pressure across the downhole tool 200. A drill or milling apparatus may then be advanced to quickly remove the relatively soft materials of the downhole tool 200 to thereby re-establish fluid flow between the upper and lower casing passages 32 and 34 of the well casing 10.

Figure 5A:
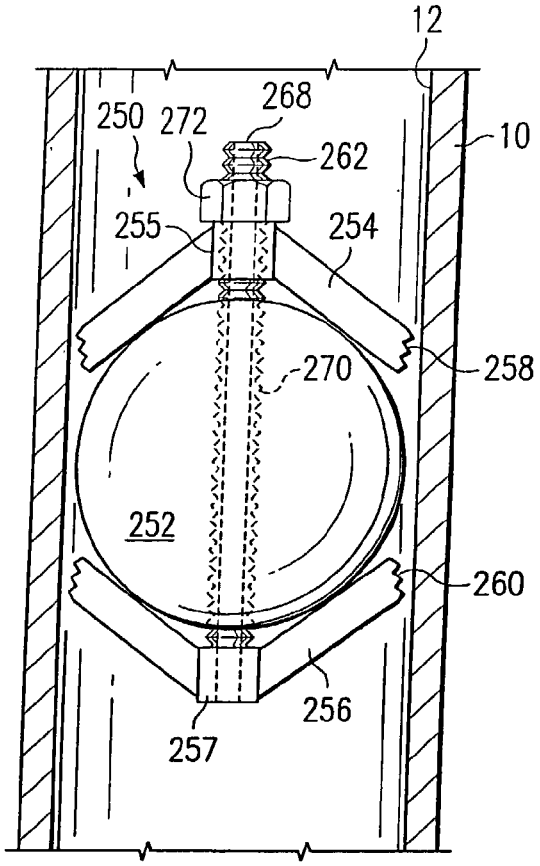
FIG. 5A is a partial cross-sectional view of a wellbore casing having a downhole tool disposed therein according to a fifth embodiment of the present invention.
Figure 5B:
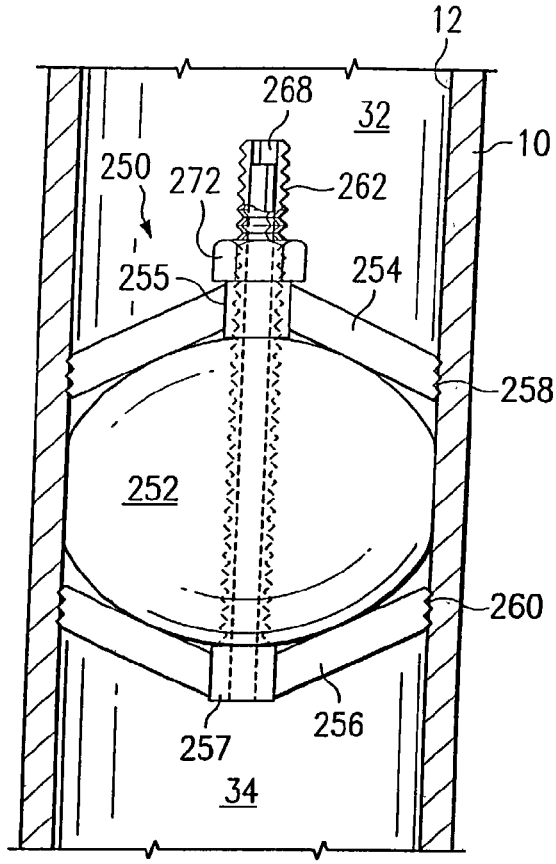
FIG. 5B is a partial cross-sectional view of the downhole tool of FIG. 5A shown in a sealing configuration.

Still a further embodiment according to the present invention is shown in FIGS. 5A and 5B within the well environment previously described including the well casing 10 and the internal surface 12. A sealing apparatus or downhole tool 250 comprises a flexible ball 252 disposed between a plurality of upper legs or gripping elements 254 and a plurality of lower legs or gripping elements 256 spaced about a central mandrel 262. Each of the upper gripping elements 254 includes gripping teeth 258 on one end and is connected to an upper gripping housing 255 on the opposite end. In a similar manner, each of the lower gripping elements 256 includes gripping teeth 260 at one end and is connected to a lower gripping housing 257 on the opposite end. The ball 252 includes a central aperture extending from an upper portion to a lower portion. The mandrel 262 extends through the central aperture, the center of the upper gripping housing 255, and the lower gripping housing 257. The mandrel 262 includes a central fluid passage 268 and a roughened outer surface consisting of a plurality of projections or teeth 270. It is understood that the mandrel 262 may include a valve (not shown) disposed in the fluid passage 268 to permit equalization of pressure above and below the sealing apparatus 250.

A ratchet assembly 272 is configured to ride on the mandrel 262 such that it may be advanced downhole and engage the teeth 270 to prevent upward movement of the upper gripping housing 255 along the mandrel 262. The ball 252 may be formed of an integral material, composite materials, or may comprise an external shell that has a fluid disposed in an interior chamber. In the relaxed condition shown in FIG. 5A, the ball 252 is substantially spherical and in the deformed condition depicted in FIG. 5B, the ball 252 is substantially toroidal.

In operation, the sealing apparatus 250 may be interconnected with a workstring (not shown) and lowered into the well casing 10 to the desired location. The workstring may include an inner mandrel and an outer sleeve longitudinally moveable along the inner mandrel. The inner mandrel may be coupled to the mandrel 262 and the outer sleeve may be positioned adjacent the ratchet assembly 272. The sealing apparatus 250 may be set into a sealing configuration by utilizing mechanical force applied by the inner mandrel to hold the mandrel 262 stable as the outer sleeve acts against the ratchet assembly 272 to push it down the mandrel 262 toward lower gripping housing 257. The upper gripping housing 255 and the attached gripping elements 254 move longitudinally downhole with respect to the mandrel 262 to thereby urge the gripping teeth 258 into engagement with the internal surface 12 of the well casing 10. Further movement of the ratchet assembly 272 downhole towards the lower gripping housing 257 tends to compress the ball 252 to a deformed shape which in turn applies force against the lower gripping elements 256 thereby forcing the gripping teeth 260 into engagement with the internal surface 12. The engagement of the gripping teeth 258 and 260 with the internal surface 12 inhibits movement of the sealing apparatus 250 within the well casing 10. Additionally, deformation of the ball 252 forces the outer surface of the ball 252 against the internal surface 12 of the well casing 10 and continues to deform the ball 252 to provide a substantial area of deformation creating a substantial area of sealing contact with the internal surface 12. The ratchet assembly 272 fixedly engages the teeth 270 on the mandrel 262 to fix the relative longitudinal position of the gripping housings 255 and 257, thus maintaining the sealing apparatus 250 in the illustrated sealing configuration depicted in FIG. 5B.

Once the sealing apparatus 250 has been set in a sealing configuration, the sealing apparatus 250 may be left in place to provide a seal between the upper casing passage 32 and the lower casing passage 34 while other well operations, known in the art, are performed. Upon the completion of the well operations, the sealing apparatus 250 may be removed from the well casing 10 by top drilling the device. During the removal procedure, a drill member (not shown) may disengage an upper one-way valve (not shown), which will, over time, equalize the pressure between upper casing passage 32 and the lower casing passage 34.

Figure 6A:
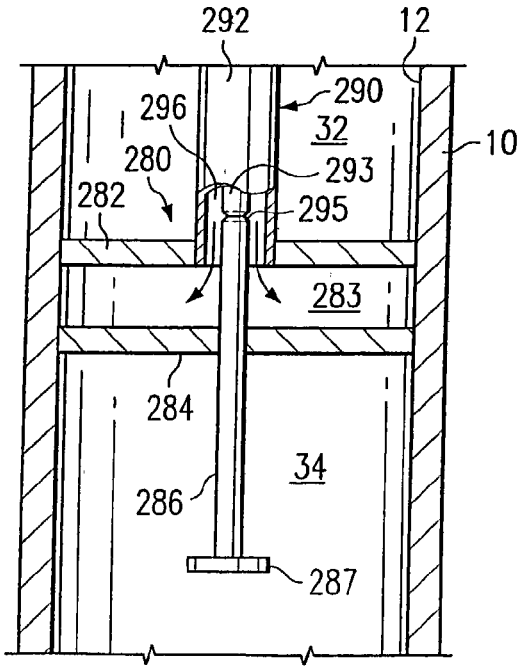
FIG. 6A is a partial cross-sectional view of a wellbore casing having a downhole tool disposed therein according to a sixth embodiment of the present invention.
Figure 6B:
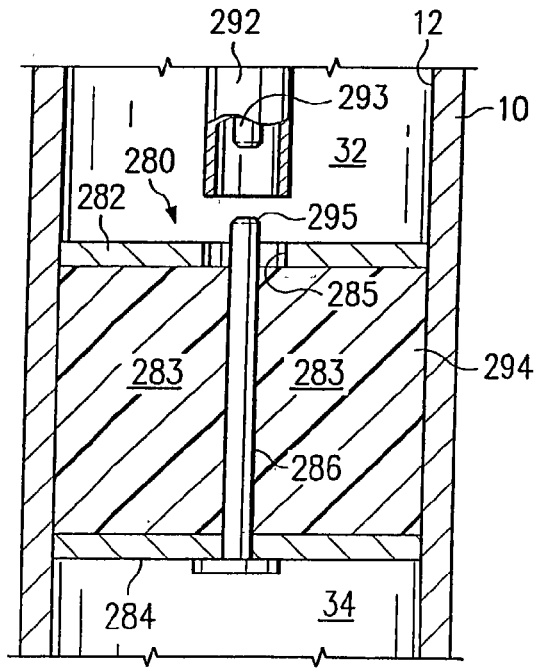
FIG. 6B is a partial cross-sectional view of the downhole tool of FIG. 6A shown in a sealing configuration.

Referring now to FIGS. 6A and 6B, there is shown a further sealing system or downhole tool 280 according to another aspect of the present invention disposed in a well casing 10 with an internal surface 12. The sealing system 280 includes a circular upper form 282 and a circular lower form 284 spaced from one another to form a cavity 283. A mandrel 286 extends through a centrally located aperture 285 in the upper form 282 and a smaller aperture in the lower form 284 to associate the upper and lower forms 282 and 284 as a sealing unit. It will be understood that the upper and lower forms 282 and 284 are slidable along the mandrel 286 but a circular flange 287 at its distal end retains the lower form 284. The upper and lower forms 282 and 284 are substantially circular and have a diameter substantially matching the internal diameter of the well casing 10 and are thereby in substantial contact with the internal surface 12.

The sealing system 280 is joined to a workstring 290 having an outer tube 292 and an inner mandrel 293 moveable therein. The outer tube 292 extends within aperture 285 and is releasably retained therein by an interference fit between the exterior of the outer tube 292 and aperture 285. The mandrel 286 is preferably formed with the inner mandrel 293 to include a shear line 295. As shown in FIG. 6B, in the sealing configuration, a sealing material 294 is disposed around the mandrel 286 and between the upper and lower forms 282 and 284 to fill cavity 283.

In operation, the upper and lower forms 282 and 284 are interconnected with workstring 290 and run into the well casing 10 to the desired location. The mandrel 286 may then be advanced from the outer tube 292 to establish the required length for the cavity 283. It will be understood that the upper and lower forms 282 and 284 may, in an optional embodiment, act as wipers for mechanically cleaning the internal surface 12 of the well casing 10 during their relative movement. Additionally, a chemical wash and activation of the internal surface 12 surrounding cavity 283 between the lower form 284 and the upper form 282 may be conducted to prepare the internal surface 12 for a sealing engagement with a fluidized seal material. After the internal surface 12 has been prepared, the sealing material 294 may be pumped through passage 296 in outer tube 292 into the cavity 283. The sealing material 294 is then allowed to cure and form a fluid tight, gripping seal with internal surface 12 of well casing 10. The outer tube 292 may then be withdrawn and mandrel 286 disconnected from inner mandrel 293 at shear line 295 such that the workstring 290 may be removed.

The upper form 282 is joined to the outer tube 292, such that the lower form 284 and the upper form 282 may be positioned relative to each other to establish the desired length of the cavity 283 and the resultant length of sealing material 294. In one aspect, the length of the sealing material 294 is greater than 12 inches. The length of the cavity 283 may be a function of the properties of the sealing material 294 used in consideration of the wellbore temperature and pressures expected. The sealing material 294 could be a resin, epoxy, cement resin, liquid glass, or other suitable material known in the art. Further, a setting compound may be mixed with the sealing material 294 to actuate curing to a hardened condition.

It will be appreciated that the mandrel 286 may include a fluid passageway and valve disposed adjacent to the upper form 282 such that the valve may be opened prior to drilling the sealing system 280 to equalize pressure above and below the sealing system 280. It will also be understood that the upper and lower forms 282 and 284 may be formed of any desired material including metal, composites, plastics, etc. Furthermore, while two forms members have been shown in the illustrative embodiment disclosed herein, it will be appreciated that only a single form would be necessary. Further, while the above described method contemplated filling the cavity 283 with a resin or epoxy, it is possible that the pumping action of the sealing material 294 against lower form 284 may urge the upper and lower forms 282 and 284 apart from one another to thereby establish a spaced apart relationship between the upper and lower forms 282 and 284 substantially filled with the sealing material 294.

Once the sealing system 280 has been set in a sealing configuration as described above, it may be left in place to provide a seal between the upper casing passage 32 and the lower casing passage 34 while other well operations, known in the art, are performed. Upon the completion of the well operations, the sealing member 280 may be removed from the wellbore by top drilling the device. During the removal procedure, a drill member (not shown) may disengage an upper one-way valve (not shown), which will, over time, equalize the pressure between upper casing passage 32 and the lower casing passage 34.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

The invention claimed is:

1. An apparatus for use in a well bore, the apparatus comprising:

a tubular member adapted to be inserted in the well bore;

a first form secured to the lower end of the tubular member;

a second form extending below the first form and movable in the well bore form to define a cavity between the first and second forms and the corresponding portion of the well bore;

a sealing material adapted to be introduced through the tubular member and into the cavity to form a seal in the well bore;

a mandrel disposed in the tubular member and extending through openings in the first and second members; and a retaining member at the lower end of the mandrel so that lowering the mandrel in the well bore permits movement of the second form relative to the mandrel and to the first form.

2. The apparatus of claim 1 further comprising a retaining member disposed on the lower end of the mandrel to limit the movement of the second form.

3. The apparatus of claim 1 further comprising a shear line formed in the mandrel and defining first and second portions of the mandrel;

wherein the first portion of the mandrel is disposed in the tubular member and the second portion of the mandrel extends through the first and second forms; and wherein the first and second portions of the mandrel are separable from each other along the shear line when the tubular member is disconnected from the first form.

4. The apparatus of claim 3 further comprising a valve connected to the mandrel and moveable between an open position in which fluid flow through a fluid passageway formed through the mandrel is permitted, and a closed position in which fluid flow through the fluid passageway is prevented.

5. The apparatus of claim 1 wherein the sealing material is pumpable into the cavity via the tubular member.

6. The apparatus of claim 1 wherein the first and second forms each have a circular cross section and the outer circumference of each form slidably engages the inner wall of the well bore.

7. A method for sealing a well bore, the method comprising:

inserting a tubular member in the well bore;

securing a first form to the tubular member that extends across the well bore;

providing a second form that extends below the first form;

disposing a mandrel in the tubular member that is adapted for movement relative to the tubular member;

providing an opening in the second form through which the mandrel extends;

lowering the mandrel in the well bore to permit movement of the second form relative to the mandrel and to the first form to define a cylindrical cavity with the well bore and the first form, the movement of the mandrel in the well bore varying the size of the cavity; and introducing a sealing material through the tubular member and into the cavity to form a seal in the well bore.

8. A method for sealing a well bore, the method comprising:

inserting a tubular member in the well bore;

securing a first form to the tubular member that extends across the well bore;

providing a second form that extends below the first form;

disposing a mandrel in the tubular member that is adapted for movement relative to the tubular member; providing an opening in the second form through which the mandrel extends;

lowering the mandrel in the well bore to permit movement of the second form relative to the mandrel and to the first form to define a cylindrical cavity with the well bore and the first form;

introducing a sealing material through the tubular member and into the cavity to form a seal in the well bore; and forming a shear line formed in the mandrel and defining first and second portions of the mandrel; and separating the first and second portions of the mandrel from each other along the shear line when the tubular member is disconnected from the first form.

9. The method of claim 8 further comprising moving a valve between an open position in which fluid flow through a fluid passageway formed through the mandrel is permitted, and a closed position in which fluid flow through the fluid passageway is prevented.

10. The method of claim 9 wherein the pressure in the well bore above the first form is equalized with the pressure in the well bore below the second form when the first form is disconnected from the tubular member, the mandrel portions are separated, and the valve is in the open position.

11. The method of claim 7 further comprising pumping the sealing material into the cavity via the tubular member.

12. The method of claim 7 wherein the first and second forms each have a circular cross section and the outer circumference of each form slidably engages the inner wall of the well bore.

13. A downhole tool apparatus for use in a wellbore, the apparatus comprising:

a first form;

a mandrel extending through the first form and from an end of a workstring removably connected to the first form;

a second form slidably engaged with the mandrel so that the mandrel extends through the second form, and the second form is moveable along the mandrel and relative to the first form to define a variable volume between the first and second forms;

means connected to an end portion of the mandrel for limiting the movement of the second form in a direction away from the first form to define a cavity between the first and second forms; and a sealing material disposed in the variable volume between the first and second forms when the first and second forms are positioned in the wellbore.

14. The apparatus of claim 13 wherein the second form engages the means to define the cavity;

wherein the variable volume between the first and second forms is equivalent to the cavity when the second form engages the means; and wherein the sealing material fills the cavity and sealingly engages the wellbore.

15. The apparatus of claim 13 wherein the means is a flange connected to the end of the mandrel.

16. The apparatus of claim 13 further comprising an internal passage formed in the workstring, the internal passage in fluid communication with the variable volume between the first and second forms;

wherein the sealing material is pumpable into the variable volume via the internal passage.

17. The apparatus of claim 16 wherein, when the sealing material is pumped into the variable volume between the first and second forms, the second form moves along the mandrel in the direction away from the first form until the second form engages the means and the cavity is defined.

18. The apparatus of claim 16 further comprising a shear line formed in the mandrel and defining first and second portions of the mandrel;

wherein the first portion of the mandrel extends through the internal passage and the second portion of the mandrel extends through the first and second forms; and wherein the first and second portions of the mandrel are separated from each other along the shear line when the workstring is disconnected from the first form.

19. The apparatus of claim 13 further comprising a fluid passageway formed through the mandrel;

wherein the apparatus is disposed between first and second regions of the wellbore when positioned in the wellbore, and the fluid passageway fluidically connects the first and second regions when the workstring is disconnected from the first form.

20. The apparatus of claim 19 further comprising a valve connected to the mandrel.

21. The apparatus of claim 20 wherein the valve is moveable from an open position in which fluid flow through the fluid passageway is permitted, and to a closed position in which fluid flow through the fluid passageway is prevented.

22. The apparatus of claim 21 wherein the pressure in the first region of the wellbore is equalized with the pressure in the second region of the wellbore when the workstring is disconnected from the first form and the valve is in the open position.

23. The apparatus of claim 20 wherein the valve is a one-way valve.

24. A method of sealing a wellbore, the method comprising:

removably connecting an end of a workstring to a first form;

advancing a mandrel through the first form and from the end of the workstring;

slidably engaging a second form with the mandrel so that the mandrel extends through the second form and the second form is moveable along the mandrel and relative to the first form to define a variable volume between the first and second forms;

connecting means to an end portion of the mandrel for limiting the movement of the second form in a direction away from the first form to define a cavity between the first and second forms; and disposing a sealing material in the variable volume between the first and second forms when the first and second forms are positioned in the wellbore.

25. The method of claim 24 wherein the step of disposing the sealing material comprises pumping the sealing material through the workstring and into the variable volume between the first and second forms.

26. The method of claim 25 wherein the step of disposing further comprises engaging the second form with the means by continuing to pump the sealing material through the workstring and into the variable volume so that the cavity is defined, the variable volume is equivalent to the cavity, and the sealing material surrounds the mandrel and fills the cavity.

27. The method of claim 26 further comprising forming a sealing engagement between the sealing material and the wellbore.

28. The method of claim 27 further comprising:

disconnecting the workstring from the first form; and separating the mandrel at a shear line formed in the mandrel so that the portion of the mandrel surrounded by the sealing material remains in place.

29. The method of claim 27 further comprising forming a fluid passageway through the mandrel.

30. The method of claim 29 further comprising connecting a valve to the mandrel.

31. The method of claim 30 wherein the valve is moveable from an open position in which fluid flow through the fluid passageway is permitted, and to a closed position in which fluid flow through the fluid passageway is prevented.

32. The method of claim 31 further comprising equalizing the pressure in a first region of the wellbore adjacent the first form with the pressure in a second region of the wellbore adjacent the second form;

wherein the step of equalizing comprises:

disconnecting the workstring from the first form;

separating the mandrel so that the portion of the mandrel surrounded by the sealing material remains in place; and moving the valve to the open position to permit fluid flow through the fluid passageway.

33. The method of claim 24 further comprising preparing the internal surface of the wellbore for a sealing engagement with the sealing material.

34. The method of claim 33 wherein the step of preparing comprises conducting a chemical wash and activating the internal surface of the wellbore.

35. The method of claim 33 wherein the step of preparing comprises mechanically cleaning the internal surface of the wellbore by positioning the first and second forms in the wellbore.

* * * * *